United States Patent [19]

Korkowski

[11] 4,223,639

[45] Sep. 23, 1980

[54] ANIMAL RESTRAINING DEVICE

[76] Inventor: James F. Korkowski, Brandon, Minn. 56315

[21] Appl. No.: 967,201

[22] Filed: Dec. 7, 1978

[51] Int. Cl.[2] ..... A61D 3/00

[52] U.S. Cl. ..... 119/98

[58] Field of Search ..... 119/103, 96, 98; 17/44 R, 44.1; 269/130, 131, 132

[56] References Cited

U.S. PATENT DOCUMENTS

| | | | |
|---|---|---|---|
| 2,829,622 | 4/1958 | Borthwick | 119/103 |
| 3,530,834 | 9/1970 | Hollenback et al. | 119/96 |
| 3,693,595 | 9/1972 | Stewart | 119/103 |

*Primary Examiner*—Hugh R. Chamblee

*Attorney, Agent, or Firm*—Schroeder, Siegfried, Ryan, Vidas, Steffey & Arrett

[57] ABSTRACT

An animal restraining device comprised of a rigid frame pivotally supporting a pair of diverging horizontal outwardly extending support arms each of which carries a sliding block bearing a loop of flexible material which extends outwardly beyond the outer end of the arm and which is drawn inwardly by foot-actuated cable means into cooperative limb-engaging position with the end of its supporting arm. Adjustable spacing means extends between the two support arms and downwardly facing bracket means for readily mounting the frame upon a vertical panel is carried at the back side of the frame.

18 Claims, 6 Drawing Figures

Fig. 2
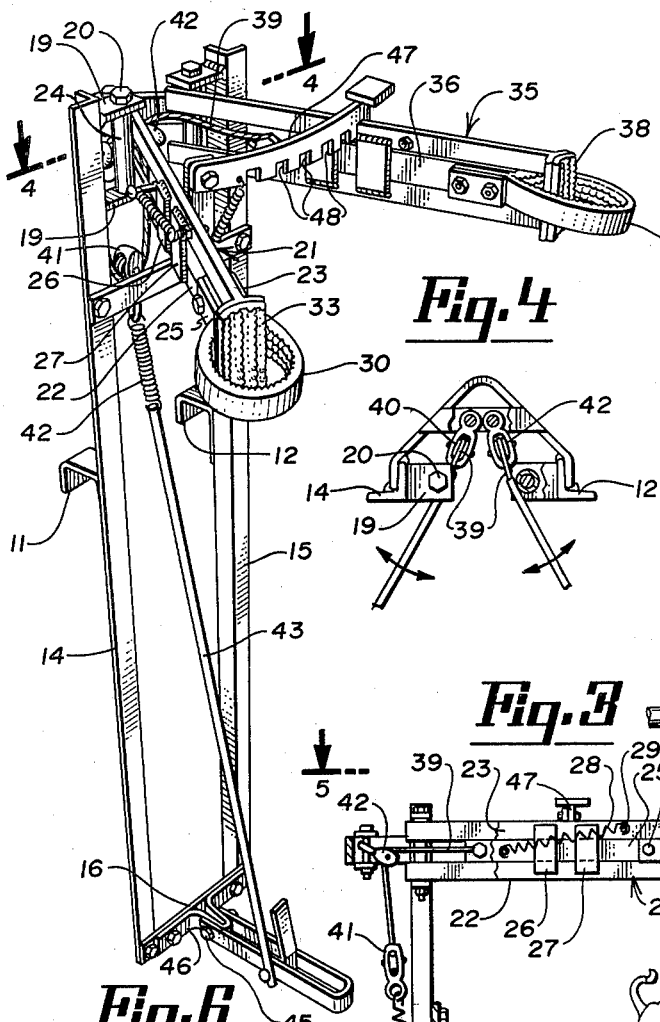
Fig. 1
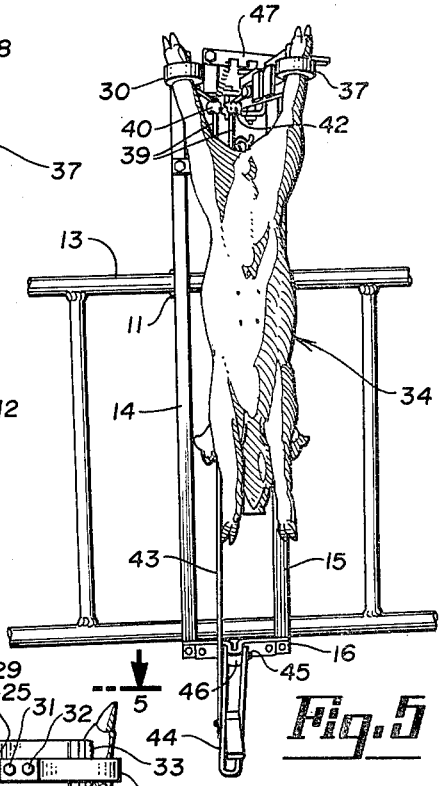
Fig. 4
Fig. 3
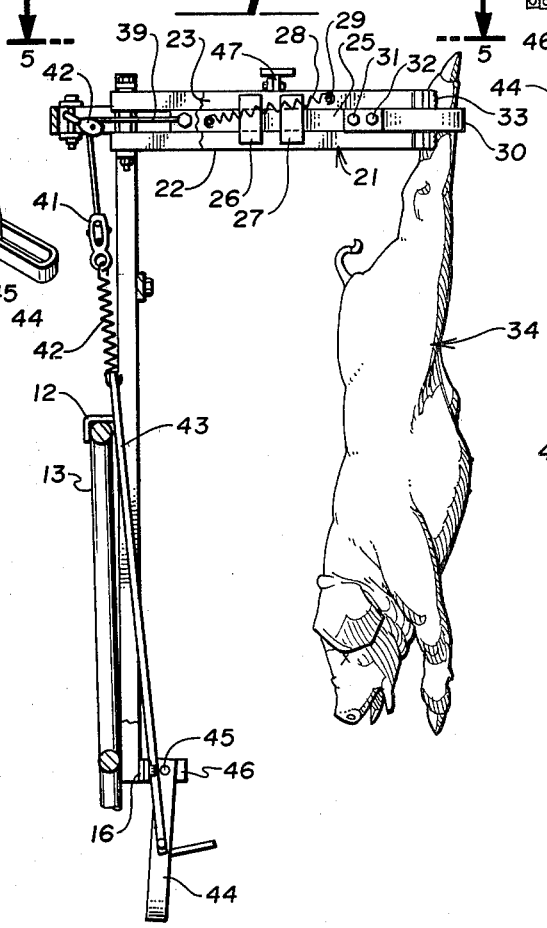
Fig. 5
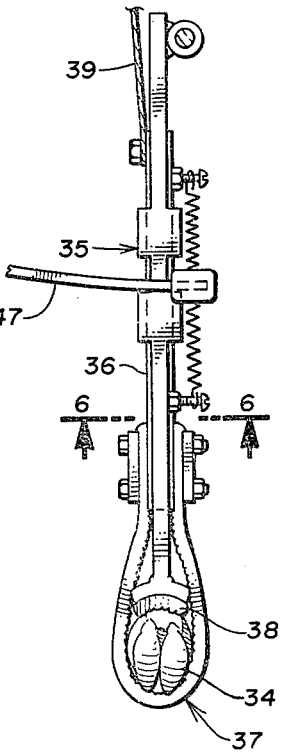
Fig. 6
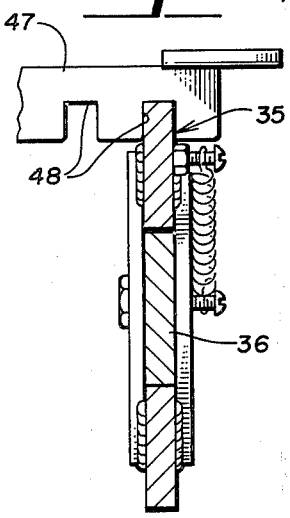

ANIMAL RESTRAINING DEVICE

It is a general object of my invention to provide a novel, simple and improved animal restraining device of simple and inexpensive construction and operation.

A more specific object is to provide an animal restraining device which will support and restrain the animal in an improved manner and is capable of utilization by a single operator.

Another object is to provide a simple and improved animal restraining device which is sturdy, but of light weight and can be readily removed from location to location in a simple and efficient manner.

Another object is to provide a novel and improved animal restraining device which is capable of ready adjustment so as to hold the animal in optimum position for treatment and/or the like.

Another object is to provide a novel and improved animal restraining device which includes inherent resiliency in the tension applied to the portions thereof which restrain the animal and which is self-adjusting.

These and other objects and advantages of my invention will more fully appear from the following description, made in connection with the accompanying drawings, wherein like reference characters refer to the same or similar parts throughout the several views, in which:

FIG. 1 is a front elevational view of my animal restraining device, shown supporting a hog in proper position for castration;

FIG. 2 is a front perspective view thereof;

FIG. 3 is a side elevational view thereof;

FIG. 4 is a horizontal sectional view taken along line 4—4 of FIG. 2;

FIG. 5 is a view taken along line 5—5 of FIG. 3; and

FIG. 6 is a vertical sectional view taken along line 6—6 of FIG. 5.

One embodiment of my invention is shown in FIGS. 1–6 and includes a rectangular open framework 10 which extends vertically and has a pair of L-shaped, downwardly facing and rearwardly extending, mounting brackets 11 and 12 adapted to engage a vertical panel 13, or horizontally extending rods to support the same in upright position. As shown, the frame 10 includes a pair of transversely spaced upright angle irons 14 and 15 which are connected at their lower ends by a cross bar 16 and adjacent their upper ends by a second cross bar 17 to provide the rectangular framework.

Mounted upon the upper end of the upright 14 and extending inwardly therefrom is a pair of vertically spaced ears 18 and 19 which support a pivot bolt 20 upon which a support arm 21 is journaled. As shown, the support arm 21 is comprised of a pair of vertically spaced parallel horizontally extending bars 22 and 23 which are welded at their inner ends to a journal 24 which surrounds the pivot pin 20.

Slidably mounted upon the support arm 21 between the two bars 22 and 23 is an elongated sliding block 25. This sliding block 25 is held in place by a pair of confining plates 26 and 27 at one side of the bars 22 and 23 and a similar pair of plates at the opposite side thereof. A spring 28 is connected to the inner end of the sliding block 25 and is anchored upon the upper bar 23 as at 29 so as to continuously urge the sliding bar 25 outwardly toward the outer end of the support arm 21.

Secured to the outer end of the sliding bar 25 at both of its ends is a loop of flexible material, such as rubber and nylon belting 30. The loop 30 extends outwardly beyond the outer end of the support arm 21 and is secured to the sliding block by means of clamps 31, the clamps being comprised of a simple metal plate at each side, such as indicated at 31 and secured with bolts 32, extending therethrough.

Secured to the outer end of the support arm 21 is a vertically extending concavely shaped member 33, its concavity facing outwardly toward the outer portions of the loop 30 and adapted to cooperate therewith in holding the leg of a animal, such as a hog 34. Thus, when the sliding block 25 is drawn inwardly, the leg of the animal 34 will be positively gripped by the element 33 and the loop 30 to support the animal at the desired level.

A second support arm 35 is mounted in an identical manner on the opposite vertical bar 15 and is constructed identically with the support arm 21. It is provided with a similar sliding block 36 and loop member 37; a concavely shaped leg-engaging member, similar to element 33, is also provided and is identified by the numeral 38.

Secured to the inner end of each of the sliding blocks 25 and 36 is a single cable 39. As shown in FIGS. 2 and 3, one end of the cable 39 is secured to the inner end of the block 25 and extends rearwardly through a sheave 40 and thence downwardly through a second sheave 41 and thence upwardly again through a third sheave 42 and is secured at its opposite end to the inner end of the sliding block 36. A spring member 42 connects the sheave 41 to an elongated link 43 which extends downwardly and is pivotally connected to a foot lever 44 at a point approximately midway between its outer end and its pivotal mounting 45. The pivotal mounting 45 consists of a U-shaped bar 46 which is fixedly mounted upon the cross bar 16 and is secured to the foot lever 44 by means of a pivot pin 45. It will be noted that the link 43 and foot lever, together with the spring 42 comprise an over-dead-center tensioning means for the cable 39 for when the foot lever is moved to the over-dead-center position shown in FIG. 3, tension is applied to the spring 42 which in turn is transmitted to the cable 39, thereby causing each of the shifting blocks 25 and 36 to be drawn inwardly to effectively clamp the leg of the hog 34 immediately below the hoof against the two concave members, 33 and 38, to thereby restrain the hog in the desired position and at the desired elevation.

Pivotally mounted upon the support arm 21 is an arcuate spacing bar 47 which is provided with a plurality of notches 48 formed in its under surface, these notches being of a dimension such as to readily receive the oppositely disposed upper bar of the support arm 35 therein. By lifting the spacing bar 47 and swinging the two supporting arms 21 and 35 toward or away from each other, and then locking them in the desired position by lowering the spacing bar 47 until one of its notches receives the support arm 35 therein, any desired spacing of support arms 21 and 35 can be provided.

In use, the frame 10 is applied to a panel 13 so as to mount the framework therein in upright position, as shown in FIG. 3. The hog is then lifted manually so that its hind hoofs are inserted within the loops 30 and 37, whereupon the operator presses the foot lever 44 downwardly to the position shown in FIG. 3, at which position the loops 30 and 37 will effectively clamp the leg of the hog within each of the loops against the concave members 33 and 38. As a result, the hog will be suspended in proper and convenient position for whatever treatment or operation, such as castration, is desired.

The spacing of the outer end of the support arms 21 and 35 can be readily adjusted so as to provide the necessary extension of the two legs of the hog, as shown in FIG. 1, in order to facilitate the castration operation. In this connection, it will be noted that modern practices call for the castration operation to be performed by making an incision in the abdomen of the hog, rather than through the scrotum and the spreading action which is applied to the legs causes the testicles to be forced outwardly through the incision as a result of the spreading action. When the operation is completed, the operator merely flips the foot lever 44 upwardly with his toe, whereupon the springs, such as spring 28 which is carried by each of the shifting blocks 21 and 35, will draw the link 43 upwardly and the shifting blocks 25 and 36 outwardly relative to supporting arms 21 and 35, thereby releasing the loops 30 and 37 and permitting the hog 34 to be freed and lowered therefrom.

I have found that the above device greatly facilitates the restraint of animals for performing operations, such as castration, and enables a single operator to perform the operation without assistance. Moreover, the animal is restrained in such a manner that the operator may utilize both hands for performing the operation and the animal is presented at the desired elevation and with the desired immobility which is so important for such operations. The device is simple and inexpensive to manufacture and operate and greatly facilitates such operations.

It will, of course, be understood that various changes may be made in the form, details, arrangement and proportions of the parts without departing from the scope of my invention which consists of the matter shown and described herein and set forth in the appended claims.

I claim:

1. An animal restraining device comprising:

(a) a frame;

(b) a pair of support arms pivotally mounted upon said frame for pivotal swinging movement about at least one vertical axis and each extending horizontally outwardly from said frame in spaced relation at approximately the same elevation;

(c) a pair of size-adjustable closed loop members, one each of which is carried by the outer end portions of one of said arms and extends outwardly therefrom;

(d) each of said loop members being shiftable relative to its said associated outer end portion between restraining and non-restraining sizes; and (e) control means carried by said frame and connected to said loop members in controlling relation to cause said loop members to move between non-restraining and restraining sizes as desired.

2. An animal restraining device comprising:

(a) a frame;

(b) a pair of support arms supported by said frame and extending generally horizontally outwardly relative thereto and having their outer end portions in laterally spaced relation and at approximately the same elevation;

(c) a pair of size-adjustable closed loop members, one each of which is carried by the outer end portion of one of said arms and extends outwardly therefrom;

(d) each of said loop members being shiftable relative to its said associated outer end portion between restraining and non-restraining sizes; and (e) control means carried by said frame and connected to said loop members in controlling relation to cause said loops to move between non-restraining and restraining sizes, as desired.

3. The structure defined in claim 2, and (f) means pivotally mounting each of said support arms on said frame for pivotal movement of said outer end portions about spaced vertical axes and toward and away from each other.

4. The structure defined in claim 2, and (f) a pair of downwardly facing mounting brackets carried by said frame and adapting the same to be rigidly mounted in upright relation.

5. The structure defined in claim 2, and (f) a pair of fixed limb-engaging members, one each of which is carried by the said outer end portion of one of said support arms and constitutes a portion of the said loop member associated with said arm to cooperatively engage with the remainder of said loop member the limb of an animal to be restrained.

6. The structure defined in claim 2, and (f) a pair of slide members, one each of which is slidably mounted upon one of said support arms and supports adjacent its outer end at least a portion of one of said loop members and moves the same as it slides between restraining and non-restraining position.

7. The structure defined in claim 2, (f) a pair of slide members, one each of which is slidably mounted upon one of said support arms and supports adjacent its outer end at least a portion of one of said loop members; and (g) said control means including cable means connected to each of said slide members and moving said portions of said loop members to animal-restraining position when said control means is activated.

8. The structure defiend in claim 2 wherein said control means includes cable means connected to at least a portion of each of said loop members and moving the same to animal-restraining position; and (f) over-dead-center cable tensioning means connected to said cable means and moving said portions of said loop members to animal-restraining positions when moved to its over-dead-center position.

9. The structure defined in claim 2 wherein each of said shiftable loop members includes a band of flexible material extending around the end of the outer end portion of its associated supporting arm.

10. The structure defined in claim 2 and adjustable rigid spacing means extending between said support arms and holding said outer end portions thereof in fixed relation as desired.

11. The structure defined in claim 2, and (f) means pivotally mounting at least one of said support arms on said frame for pivotal movement about a vertical axis to permit said outer end portions thereof to be moved toward and away from each other.

12. The structure defined in claim 11, and adjustable means for locking said support arms in selected, fixed positions relative to each other.

13. The structure defined in claim 1 wherein each of said loop members includes an animal limb-engaging member fixedly carried by the outer end portion of its said supporting arm and having a concave surface facing the outermost portions of said loop member.

14. An animal restraining device comprising:

(a) an open rectangular vertically extending rigid framework;

(b) a pair of support arms each pivotally mounted upon opposite sides of said framework at approximately the same elevation for swinging movement about a separate vertical axis and extending outwardly from one side of said framework in spaced relation to each other;

(c) a pair of sliding blocks, one each of which is slidably mounted upon the outer end portion of said support arms;

(d) a pair of bands of flexible material each having both of its opposite ends secured to one of said blocks and each extending outwardly therefrom, thereby forming a closed loop extending outwardly beyond the outer end of its supporting arm; and (e) control means connected to each of said blocks for drawing the same and its associated loop toward said framework to bring said loop into cooperative restraining position relative to the outer end portion of its supporting arm.

15. The structure defined in claim 14 and a pair of concave limb-engaging members each carried by the outer end portion of one of said supporting arms and cooperating with its associated band of flexible material to positively grip the leg of the animal to be restrained.

16. The structure defined in claim 14 and a pair of rearwardly and downwardly extending L-shaped brackets mounted upon the side of said framework opposite to that from which said supporting arms extend for readily mounting said framework in vertically extending relation upon a vertically extending panel.

17. The structure defined in claim 14, wherein said control means includes resiliently loaded cable means connected to each of said blocks.

18. The structure defined in claim 15 wherein said control means includes a single length of cable connected to each of said sliding blocks;

(f) over-dead-center tensioning means carried by said framework; and (g) sheave means through which said cable extends, said sheave means being carried by said framework and said tensioning means and connecting said cable to said tensioning means.

* * * * *